US006544093B2

(12) United States Patent
Komuro

(10) Patent No.: US 6,544,093 B2
(45) Date of Patent: Apr. 8, 2003

(54) REVOLVING AND FLYING TOY

(75) Inventor: Yuichi Komuro, Koga (JP)

(73) Assignee: Lumica Corporation, Koga (JP)

( * ) Notice: Subject to any disclaimer, the term of this patent is extended or adjusted under 35 U.S.C. 154(b) by 0 days.

(21) Appl. No.: 09/897,597

(22) Filed: Jul. 3, 2001

(65) Prior Publication Data

US 2002/0034918 A1 Mar. 21, 2002

(30) Foreign Application Priority Data

Sep. 19, 2000 (JP) ..... 2000-282905

(51) Int. Cl.[7] ..... A63H 27/00

(52) U.S. Cl. ..... 446/47; 446/46; 446/219; 473/570

(58) Field of Search ..... 446/34, 46, 47, 446/200, 224, 219, 267, 484; 473/570, 588, 589; 244/12.2, 23 C; 206/219–222

(56) References Cited

U.S. PATENT DOCUMENTS

| | | | | | |
|---|---|---|---|---|---|
| 3,273,499 | A | * | 9/1966 | Proell | 102/336 |
| 3,774,022 | A | * | 11/1973 | Dubrow et al. | 102/336 |
| 4,015,111 | A | * | 3/1977 | Spector | 273/DIG. 24 |
| 4,086,723 | A | * | 5/1978 | Strawick | 273/DIG. 24 |
| 4,207,702 | A | * | 6/1980 | Boatman et al. | 446/219 |
| 4,254,575 | A | * | 3/1981 | Gould | 446/219 |
| 4,290,226 | A | * | 9/1981 | Stauffer | 446/46 |
| 4,466,212 | A | | 8/1984 | Lehman | 446/46 |
| 5,083,799 | A | | 1/1992 | Thill | 273/424 |
| 5,683,316 | A | | 11/1997 | Campbell | 473/570 |
| 5,882,239 | A | | 3/1999 | Trichak | 446/46 |

* cited by examiner

*Primary Examiner*—Derris H. Banks
*Assistant Examiner*—Bena B. Miller
(74) *Attorney, Agent, or Firm*—Armstrong, Westerman & Hattori, LLP

(57) ABSTRACT

A highly entertaining revolving and flying toy which is manufactured at low cost and can be seen in the dark. A revolving disk-shaped body 2 is provided with an insert pocket 2*g* in which chemical luminous body 3 is placed.

9 Claims, 13 Drawing Sheets

REVOLVING AND FLYING TOY

BACKGROUND OF THE INVENTION

FIELD OF THE INVENTION

This invention relates to a revolving and flying toy, which is played with by being thrown into the air so that it revolves as it flies.

BACKGROUND OF THE INVENTION

Conventionally, it has been impossible to play with a revolving and flying toy after dark or in a dark place since it is played with by being thrown into the air. To solve this problem, luminous paint has been applied on a revolving and flying toy so that it can be seen in the dark. However, there has been little entertaining nature in the luminescence itself.

SUMMARY OF THE INVENTION

An object of the present invention is to solve the above described problem and provide a highly entertaining revolving and flying toy which can be seen in the dark and manufactured at low cost.

To achieve this object, the present invention includes the following aspects:

1) A revolving and flying toy, which is played with by being thrown into the air, having a luminous body, said luminous body emits light by a chemical reaction wherein two types of chemical luminous liquids which emit light by mixing are separately stored in said revolving and flying toy, and when the separating portion is broken by an outside pressure, said chemical luminous liquids are mixed together thereby emitting light.
2) The revolving and flying toy as set forth in 1), which is manufactured with a soft material and is capable of folding, comprising a ring-shaped air bag, said air bag having an air opening through which the air is blown into or released from the air bag so as to inflate or deflate the air bag thereby keeping the shape of the air bag in a disk shape.
3) The revolving and flying toy as set forth in 1) or 2), having a structure wherein chemical luminous materials are placed in a revolving disk-shaped body which can be removed freely.
4) The revolving and flying toy as set forth in 3), having a structure wherein the chemical luminous body is removably placed in the disk-shaped body, said disk-shaped body having an insert pocket in which said chemical luminous body is inserted.
5) The revolving and flying toy as set forth in either one of 1)–4), having a structure wherein a plurality of arc-shaped chemical luminous bodies are placed.
6) The revolving and flying toy as set forth in either one of 1)–5), wherein at least a portion of a revolving disk-shaped body having the chemical luminous body is made to be transparent or translucent.
7) The revolving and flying toy as set forth in either one of 1)–6), having a structure wherein the emission of light occurs with a plurality of colors.
8) The revolving and flying toy as set forth in either. one of 1)–7), wherein letters, drawings or patterns are placed on the surface of said revolving disk-shaped body so that said letters, drawings or patterns appear on the surface.

According to the present invention, there are provided two chemical luminous liquids of a chemical luminous body which are stored separately with a dividing section, and this dividing section is broken so that the two chemical luminous liquids are mixed together, emitting light by a chemical reaction. The chemical luminous body emits light in this way and this revolving and flying toy is thrown into the air so as to revolve with the emission of light in a revolving pattern. The revolving disk-shaped body is made of a soft material and is provided with a ring-shaped air bag on its lower part so that the revolving disk-shaped body can be folded freely and maintains the shape by blowing the air into the ring-shaped air bag. The chemical luminous body is removable so that it can be removed when it is not used and the revolving and flying toy can be used without the chemical luminous body. The revolving disk-shaped body is provided with an insert pocket into which the chemical luminous body is inserted and the insert pocket is removable by being pulled out. The chemical luminous body is arc-shaped so that, when it is thrown into the air so as to revolve, the emitting light of the chemical luminous body can be seen in a ring shape. At least a portion of the revolving disk-shaped body which is provided with the chemical luminous body, is made to be transparent or translucent so that the emitting light from the chemical luminous body can be seen clearly. The emitting light, having a plurality of colors, becomes brighter or mixed-colored with the plurality of colors. Letters, drawings or patterns are placed on the surface of the revolving disk-shaped body so as to appear by the emission of light of the chemical luminous body.

Figure 1:
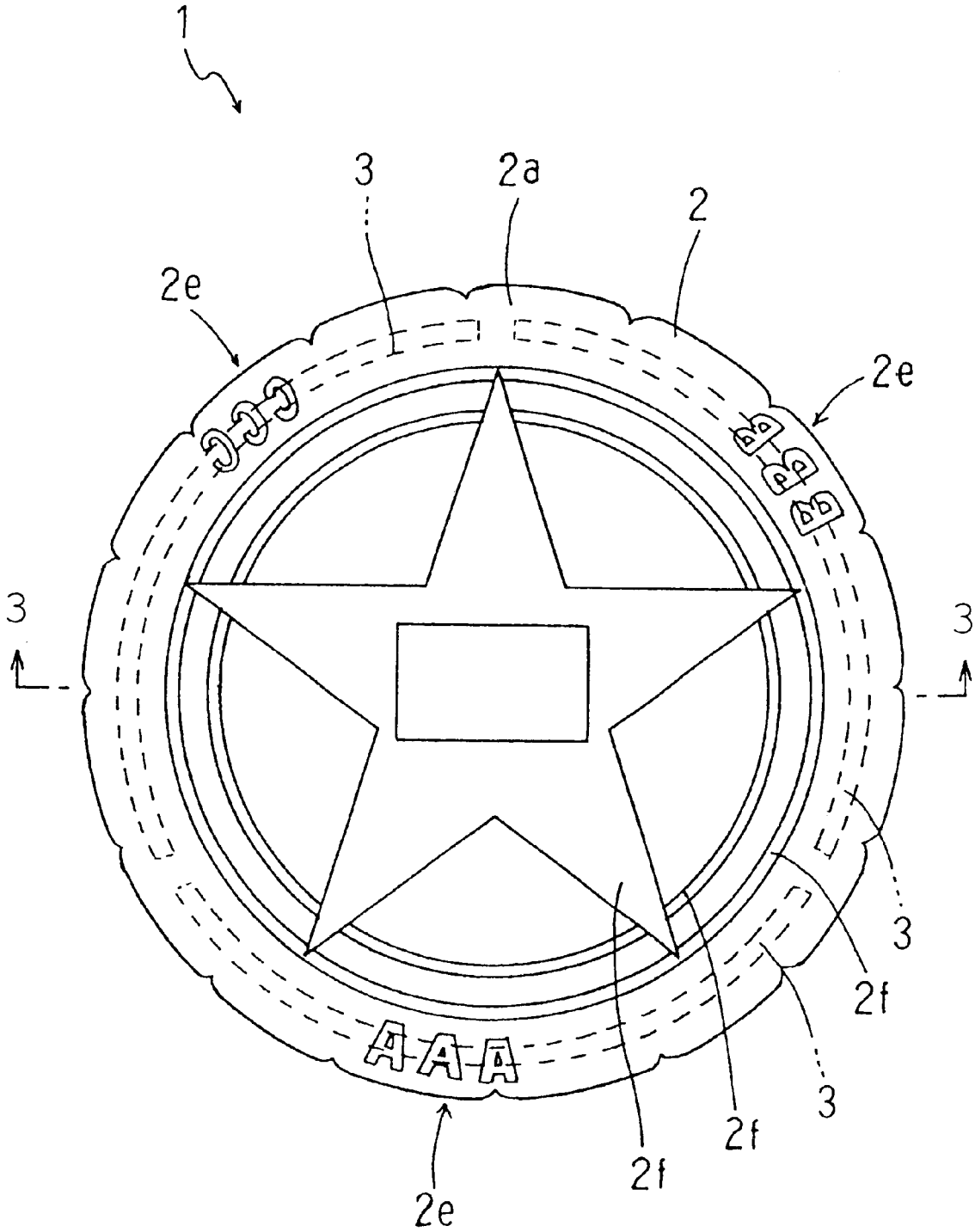
FIG. 1 is a plane view of the revolving and flying toy of the first embodiment.

The reference numerals represent as follows: 1: revolving and flying toy; 2: revolving disk-shaped body; 2*a*:disk-shaped portion; 2*b*: air bag; 2*c*: air inflation opening; 2*e*: letter section; 2*f*: drawing section; 2*g*: insert pocket; 2*h*: opening (for the insert pocket); 3: chemical luminous body; 3*a*: cylindrical container; 3*b*: ampule; 3*c*: chemical luminous liquid; 3*d*: chemical luminous liquid.

DETAILED DESCRIPTION OF THE PREFERRED EMBODIMENT

There are two types of chemical luminous liquids, which emit light by being mixed so as to provoke a chemical reaction, generally oxide liquid and fluorescent liquid. Among the oxide liquid, there are dimethyl phthalate, $H_2O_2$ (hydrogen peroxide), sodium salicylate and the like, and among the fluorescent liquid, there are generally used dimethyl phthalate fluorescent substance, reaction substance and the like. There are generally used an ampule which is usually made of thin glass, and a cylindrical container which is made of a resin so as not to break by being slightly bent. When the cylindrical container is bent, only the ampule is broken so that the two types of the chemical luminous liquids are mixed together. In order to emit light with colors, there are provided such methods as coloring the chemical luminous liquids, coloring the cylindrical container, coloring a sheet that is mounted on the cylindrical container, and coloring the insert pocket. Thus, it is possible to emit light with whatever methods available.

Now, each of the embodiments of the present invention will be described with reference to the drawings.

According to the embodiments shown in the FIGS. 1–8, there is provided a revolving and flying toy which has a revolving disk-shaped body which is made of a soft material. An air bag is mounted on the lower part of the revolving-disk-shaped body. A transparent and arc-shaped insert pocket is mounted on the revolving disk-shaped body. An upper surface of the revolving disk-shaped body is made of a soft material, which has a structure of emitting light with a plurality of colors so that letters or patterns appear on the surface of the revolving disk-shaped body.

Figure 2:
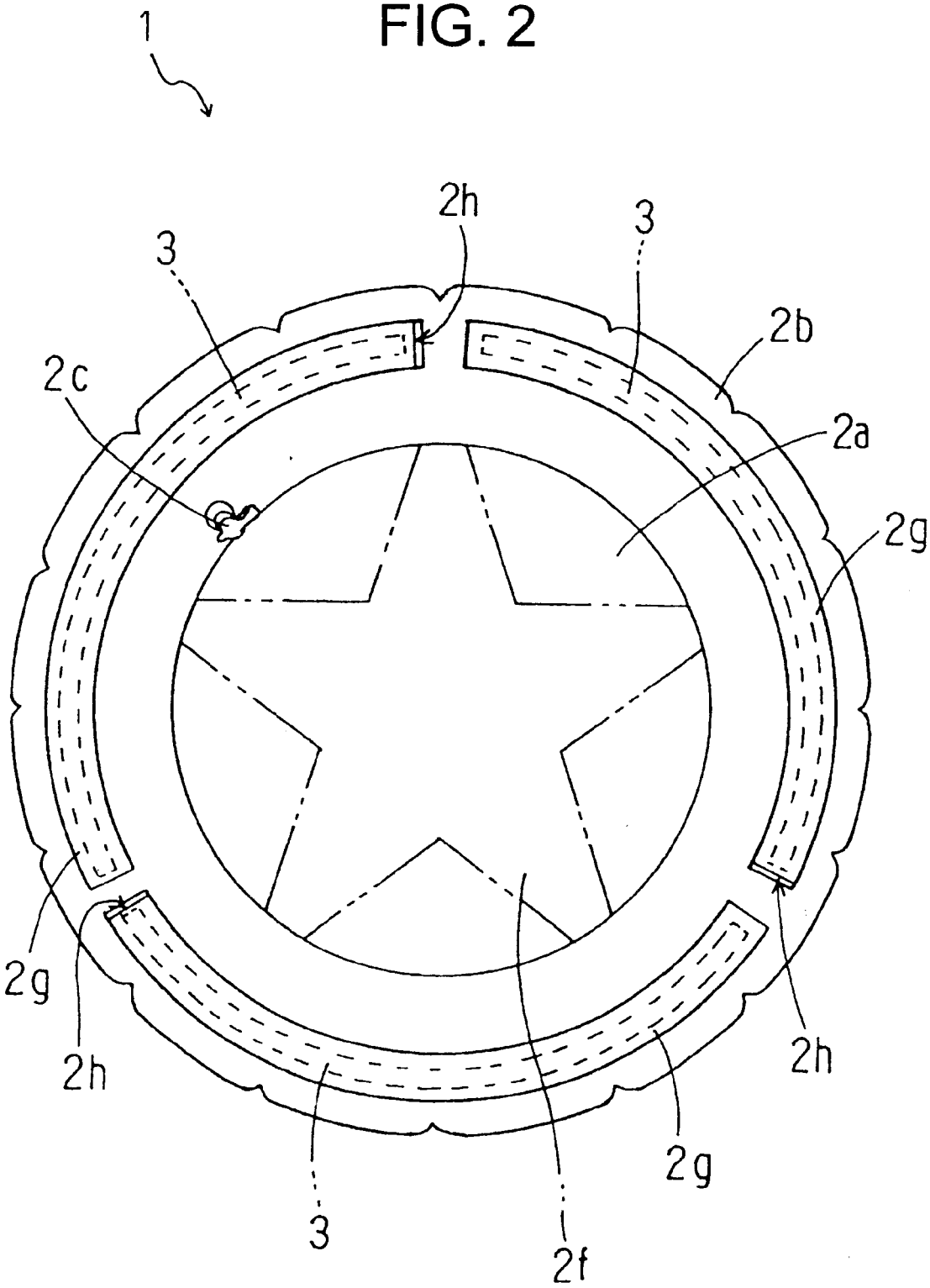
FIG. 2 is a bottom view of the revolving and flying toy of the first embodiment.
Figure 3:
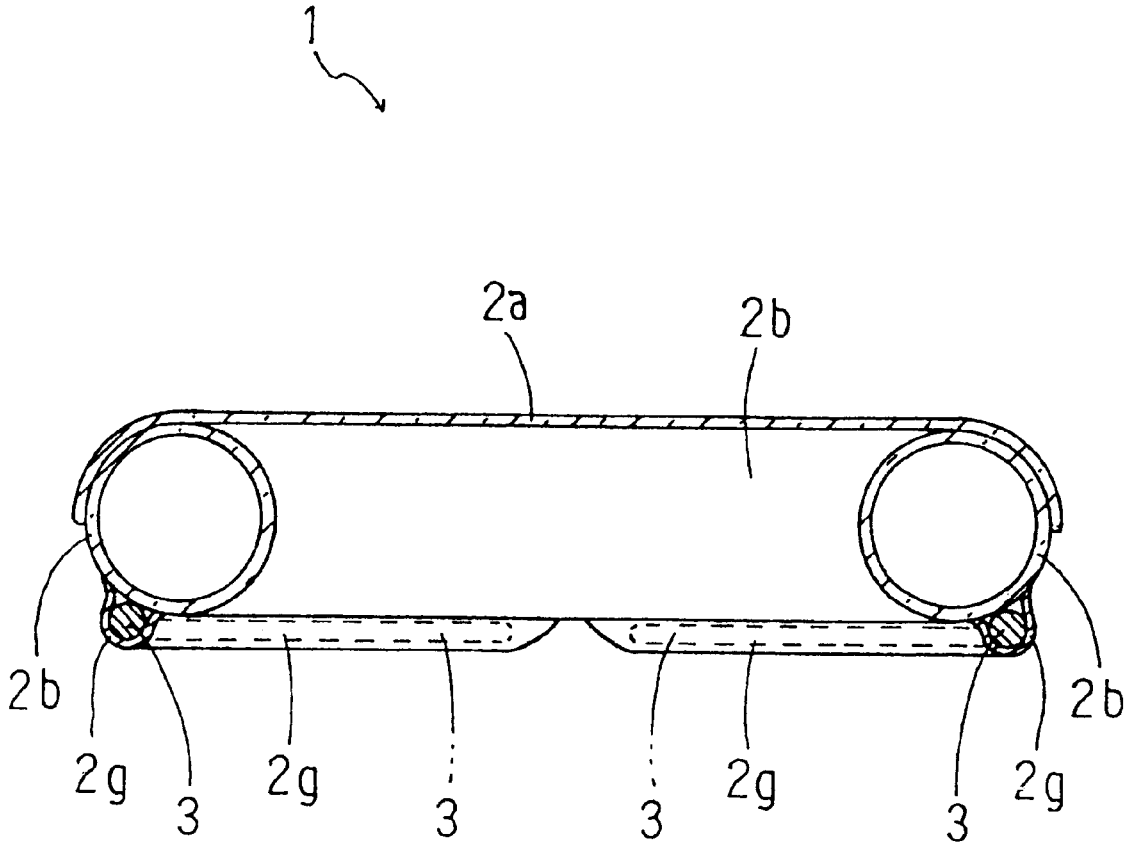
FIG. 3 is a sectional view taken along the 3—3 line in FIG. 1.
Figure 4:
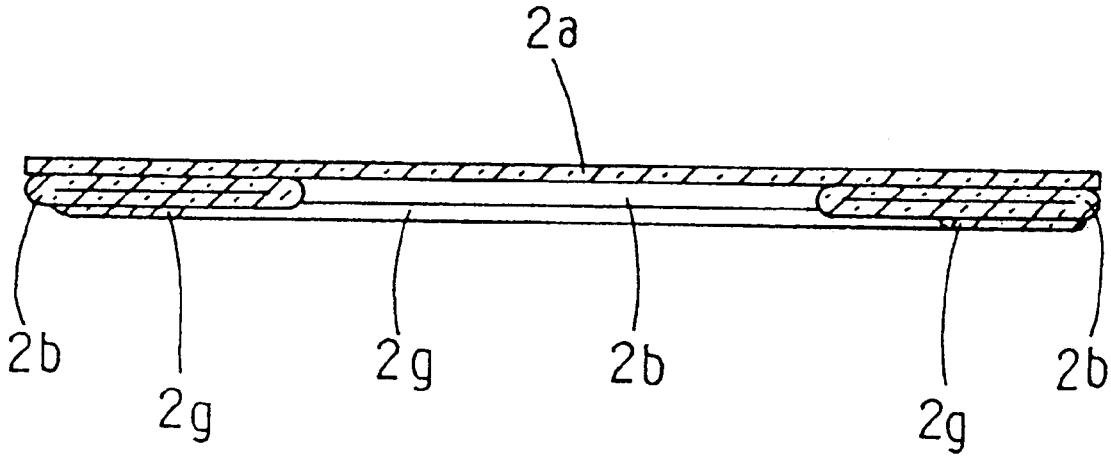
FIG. 4 is a sectional view illustrating a deflating state of the air bag of the revolving and flying toy of the first embodiment.
Figure 5:
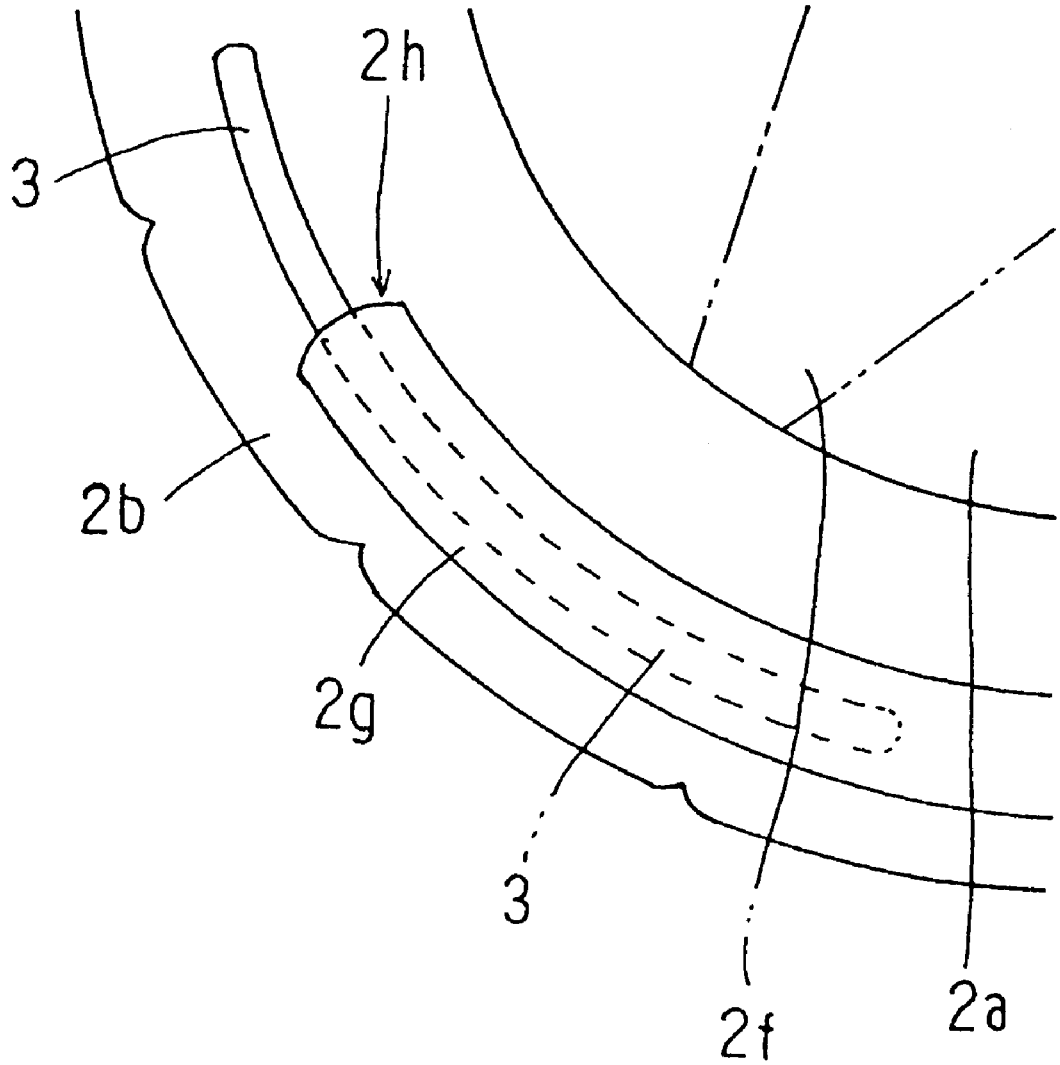
FIG. 5 is an explanatory view of the revolving and flying toy of the first embodiment.
Figure 6:
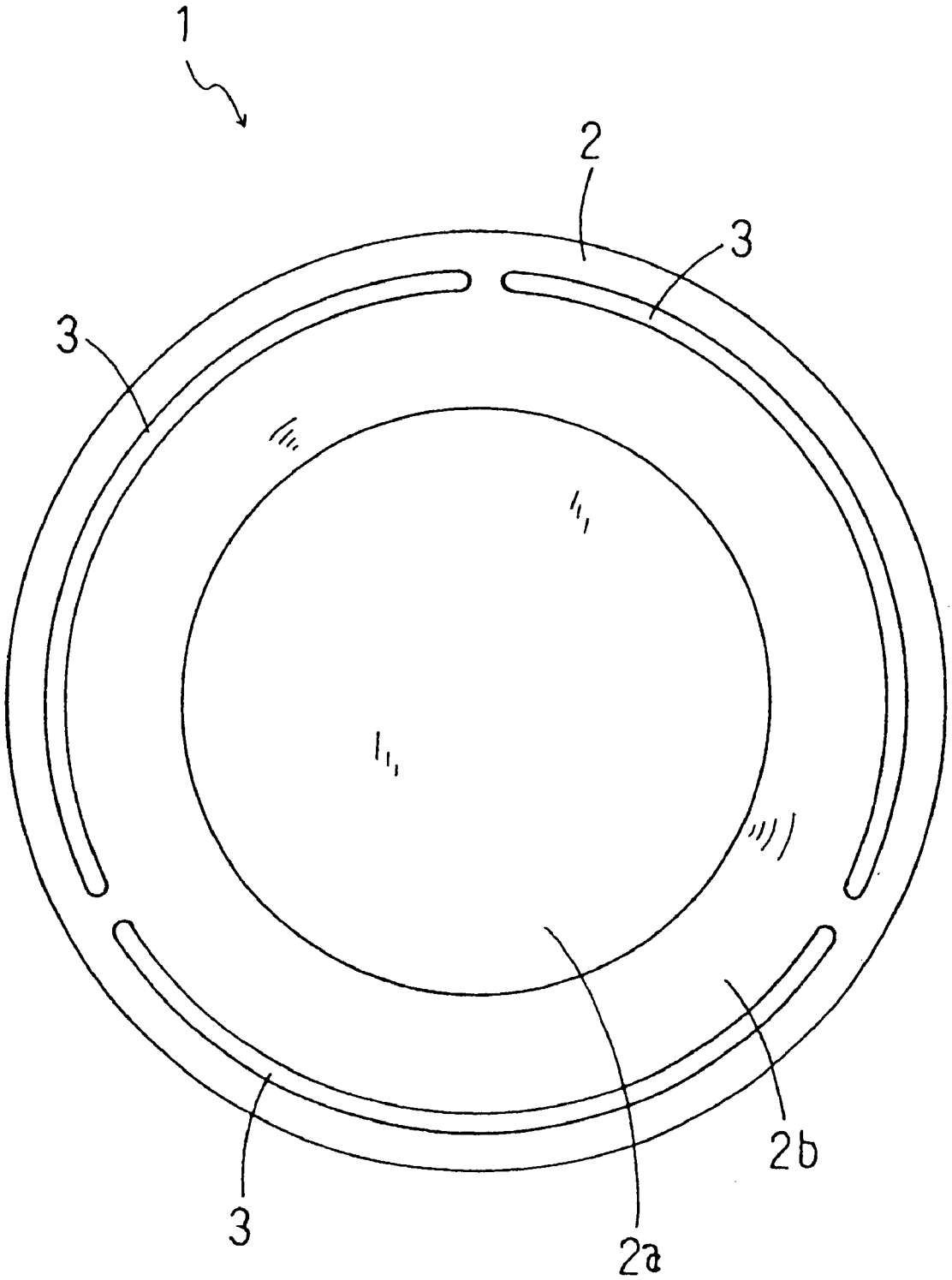
FIG. 6 is an explanatory view of the revolving and flying toy of the second embodiment.
Figure 7:
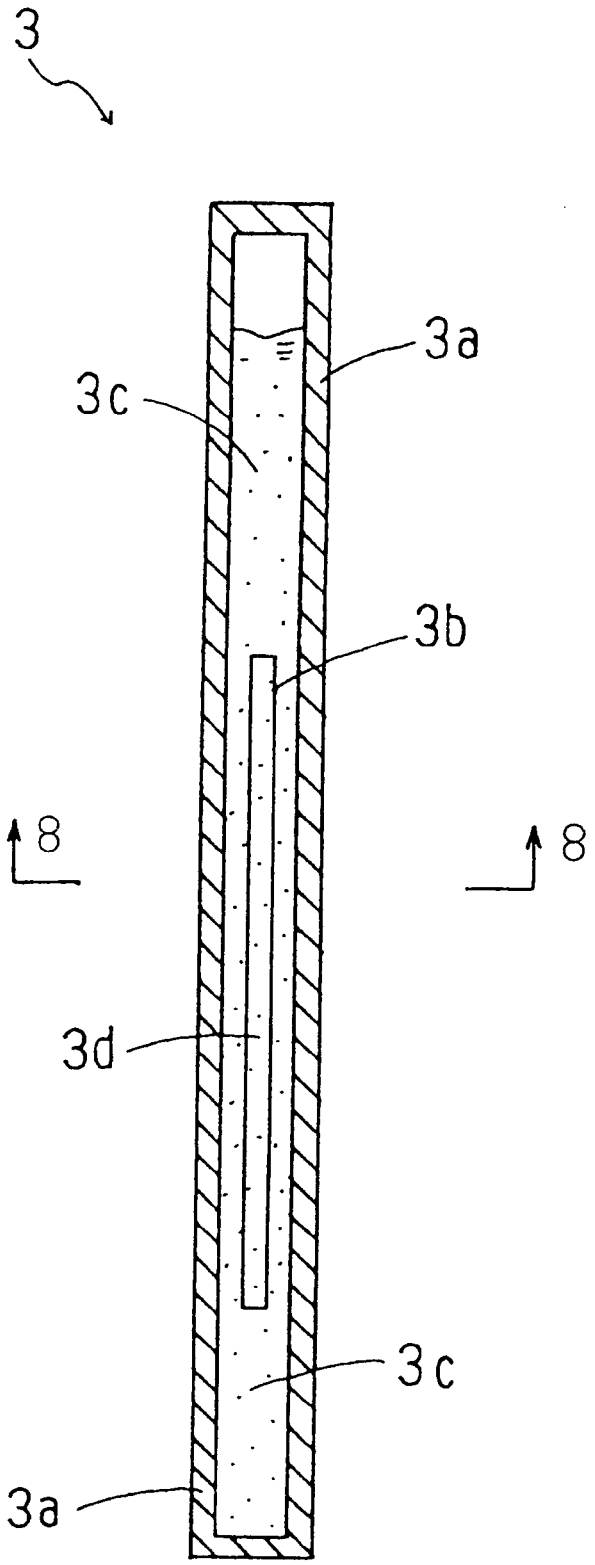
FIG. 7 is an explanatory view of an example of the chemical luminous body for the revolving and flying toy of the embodiment.
Figure 8:
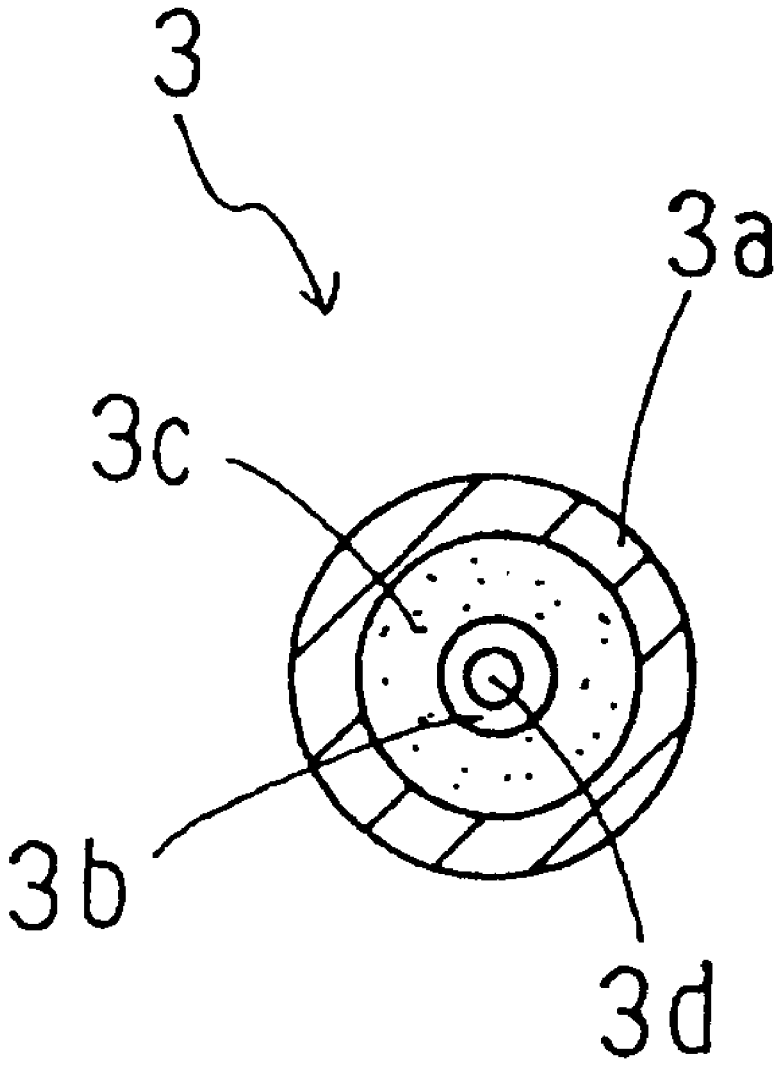
FIG. 8 is a sectional view taken along the 8—8 line in FIG. 7.
Figure 9:
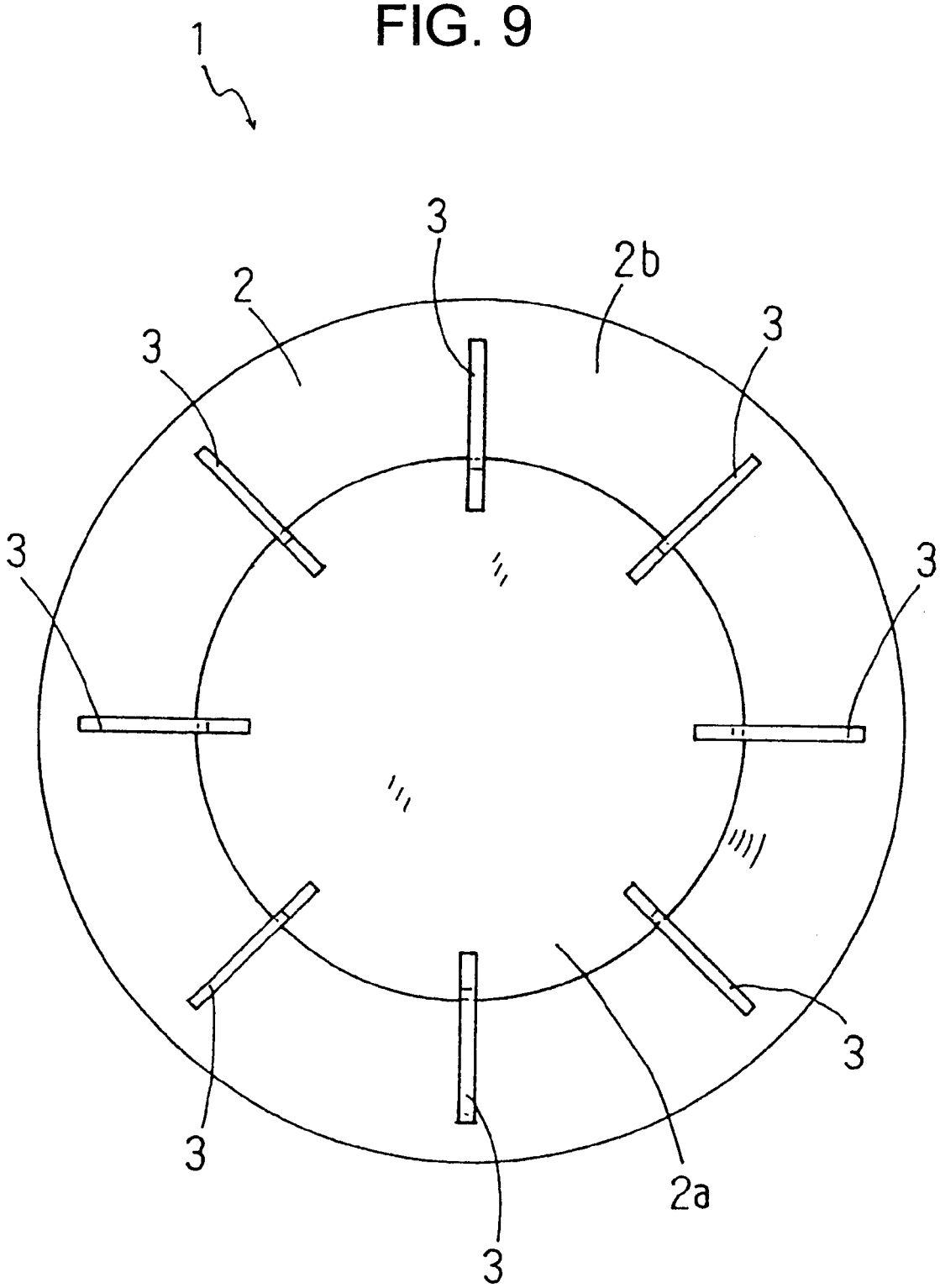
FIG. 9 is an explanatory view of the revolving and flying toy of the third embodiment.
Figure 10:
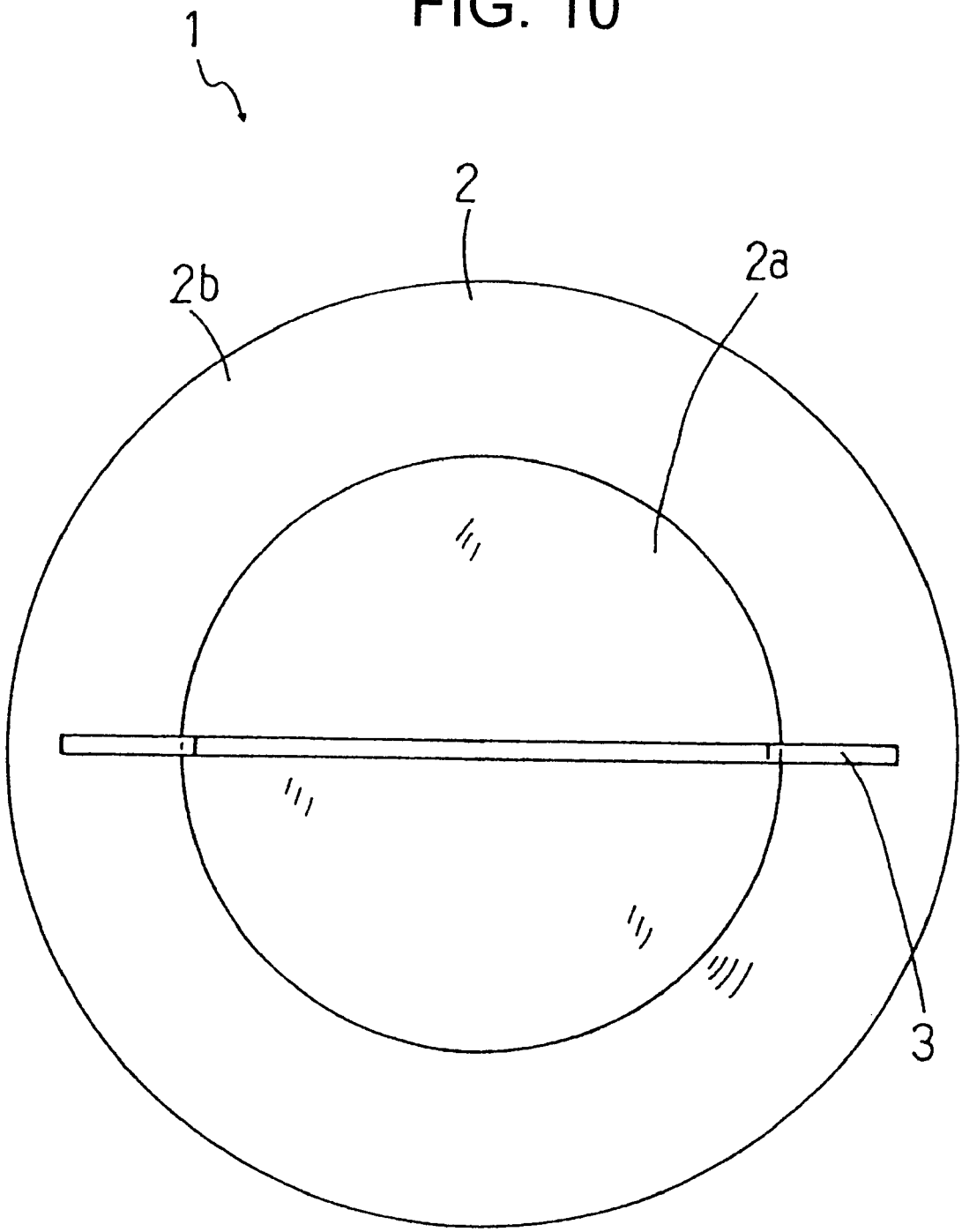
FIG. 10 is an explanatory view of the revolving and flying toy of the third embodiment.
Figure 11:
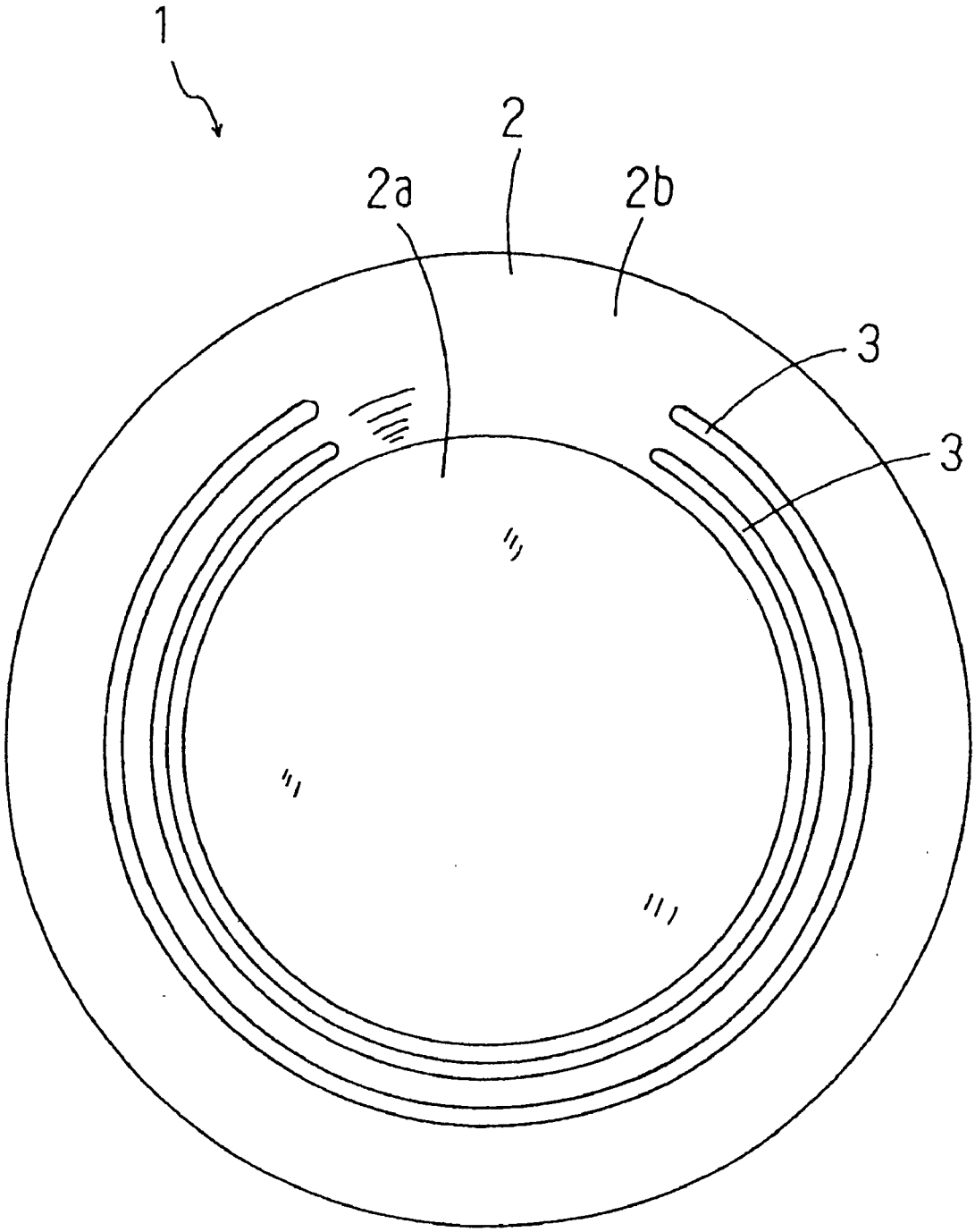
FIG. 11 is an explanatory view of the revolving and flying toy of the fourth embodiment.

FIG. 1 is a plane view of the revolving and flying toy of the first embodiment; FIG. 2 is a bottom view of the revolving and flying toy of the first embodiment; FIG. 3 is a sectional view taken along the 3—3 line in FIG. 1; FIG. 4 is a sectional view illustrating a deflating state of the air bag of the revolving and flying toy of the first embodiment; FIG. 5 is an explanatory view of the revolving and flying toy of the first embodiment; FIG. 6 is an explanatory view of the revolving and flying toy of the second embodiment; FIG. 7 is an explanatory view of an example of the chemical luminous body for the revolving and flying toy of the embodiment; and FIG. 8 is a sectional view taken along the 8—8 line in FIG. 7.

In the figures, 1 refers to the revolving and flying toy. Similarly, 2 refers to the revolving disk-shaped body. 2*a* refers to a disk section. 2*b* refers to the bag. 2*c* refers to an air inflation. opening. 2*e* refers to a letter section. 2*f* refers to a drawing section. 2*g* refers to an insert pocket. 2*h* refers to an opening for the insert pocket. 3 refers to the chemical luminous body. 3*a* refers to the cylindrical container. 3*b* refers to the ampule. 3*c* and 3*d* refer to the chemical luminous liquids.

The revolving and flying toy 1 of the embodiment, as shown in FIGS. 1–8, consists of the revolving disk-shaped body 2 on which the chemical luminous body 3 is mounted. First, on the revolving disk-shaped body 2, there is mounted the disk-shaped section 2*a* which is transparent and is made of a soft resinous material having a circular shape. Next, there is provided the air bag 2*b* within which there is a space that is made by placing soft resinous plates on top of each other, whose external shape is circular being identical to that of the disk-shaped section 2*a* thereby joining the edge of the inner circumference with the edge of the outer circumference. This air bag 2*b* circumferentially connects to the air bag 2*b* by circulating the outer circumference section on the lower side of the disk-shaped section 2*a*. Next, on the lower side of the air bag 2*b*, there is provided the air inflation opening 2*c* through which the air is blown into or released from the inside space. Next, as shown in FIGS. 2–5, there is provided the insert pocket 2*g* which is arc-shaped, belt-shaped, and transparent, and is made of a soft resinous material. This insert pocket 2*g*, as shown in FIG. 5, is bag-shaped wherein two longer sides and one shorter side of the edges of the outer circumference of the insert pocket 2*g* are attached to the lower side of the air bag 2*b* whereas the other shorter side of the edges of the outer circumference is open thereby forming the opening 2*h*. Through this opening 2*h*, an open space between the insert pocket 2*g* and the air bag 2*b* is created. This insert pocket 2*g* is mounted on three places on the lower side of the air bag 2*b*. Next, as shown in FIG. 1, on the upper side of the revolving disk-shaped body, there is provided the drawing section 2*f* consisting of a combination of two circumferential lines and a star shape, said star shape having a square-shaped section in the center. Further, on the outer circumferential side of the drawing section 2*f* and on the upper side of the disk-shaped body, there is provided the letter section 2*e* consisted of letters. The chemical luminous body 3 can also be mounted directly on the revolving disk-shaped body 2 without pockets, as shown in FIG. 6.

Next, the chemical luminous body 3 is provided. As shown in FIGS. 7 and 8, the chemical luminous body 3 consists of the chemical luminous-liquid 2*d* which is enclosed in the ampule 3*b* which has an easily-broken strength, said ampule 3*b* being enclosed in the cylindrical container 3*a* together with the chemical luminous liquid 3*c*. Of the embodiment of the present invention, there are provided three chemical luminous bodies that fit the length of the insert pocket 2*g*, each emitting different colors.

In order to play with the revolving and flying toy 1 of the embodiment of the present invention, the air is blown into the inside of the air bag 2*b* through the air inflation opening 2*c*. When the air bag 2*b* is inflated, changing from the state shown in FIG. 4 to that shown in FIG. 3, the air bag 2*b* is inflated in a doughnut shape thereby steadily keeping the shape of the revolving disk-shaped body 2. Next, when a force is applied to bend off the chemical luminous body 3, the ampule placed inside the chemical body 3 is broken thereby mixing the chemical luminous liquid 3*c* and the chemical luminous liquid 3*d*, which emit light by a chemical reaction. In this way, the chemical luminous body 3 emits light. In this state, the chemical luminous body 3 is placed on the revolving disk-shaped body 2 in such a manner that the chemical luminous body 3 is bent so as to become parallel to the insert pocket 2*g*, and inserted between the insert pocket 2*g* and the air bag 2*b* through the opening edge of the insert pocket 2*g*, as shown in FIG. 5. In this way, three chemical luminous bodies 3 are put in place.

By placing the chemical luminous bodies 3 on the revolving disk-shaped body 2, the revolving disk-shaped body 2 becomes greatly conspicuous which is highly entertaining, since the chemical luminous bodies emit light with different colors. In addition, the letter sections 2*c* that are put in three places appear with different colors so as to be recognizable and stand out. Furthermore, the drawing sections 2 stand out with the emission of light of the chemical luminous bodies 3, making them become conspicuous so as to be recognizable even if a plurality of the revolving and flying toys are being used, which is entertaining. Moreover, by emitting light in this way, the revolving and flying toy 1 is unlikely to be lost even if used in the dark and during the dark hours, and it is easy to be located when the sight is lost. This revolving and flying toy 1 is highly entertaining in that, when it is thrown into the air so as to revolve, emission of light with three different colors revolves making it look like a ring shape. The revolving and flying toy 1 of the embodiment, wherein the chemical luminous body 3 is freely removable, is even more highly entertaining in that it is possible to exchange the chemical luminous body 3 with that of different colors. In addition, the revolving disk-shaped body 2 is made of a soft resinous material having the air bag 2*b* into which the air is blown to keep it inflated thereby to float on the water. Therefore, it is unlikely to happen that the revolving and flying toy 1 be lost when played with on the river or the ocean, enabling it to be used for a variety of purposes. Furthermore, due to this structure, it is possible to prevent accidents in which the revolving and flying toy I is thrown into the air hitting and injuring a person or those in which objects are broken by being hit by the revolving and flying toy 1.

After the use of the revolving and flying toy 1, the chemical luminous body 3 is removed by being pulled out from the insert pocket 2*g*. Next, the air is released from the air bag 2*b* through the air inflation opening 2*c* so as to become the state as shown in FIG. 4. Since the revolving disk-shaped body 2 is made of a soft resinous material, it is possible to carry or store the revolving and flying toy 1 by folding it to make it compact, which is very convenient. Additionally, the folded revolving disk-shaped body 2 can be put into a garment pocket, which makes it possible to carry the revolving and flying toy 1 readily.

Other examples of the embodiments of the revolving and flying toy are shown in FIGS. 9–14. It is possible to change the positioning, number and letter of the chemical luminous body 3.

Figure 12:
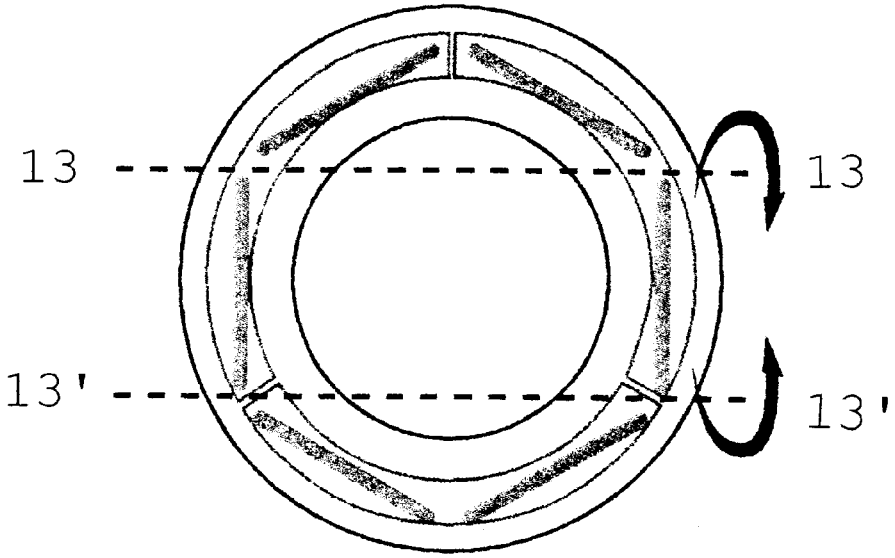
FIG. 12 is an explanatory view of the revolving and flying toy of the fifth embodiment.
Figure 13:
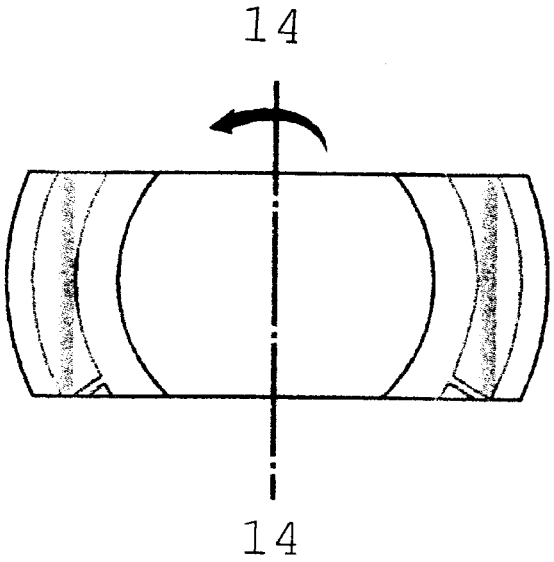
FIG. 13 is a view of the revolving and flying toy of the fifth embodiment folded at lines 13—13 and 13'—13'.
Figure 14:
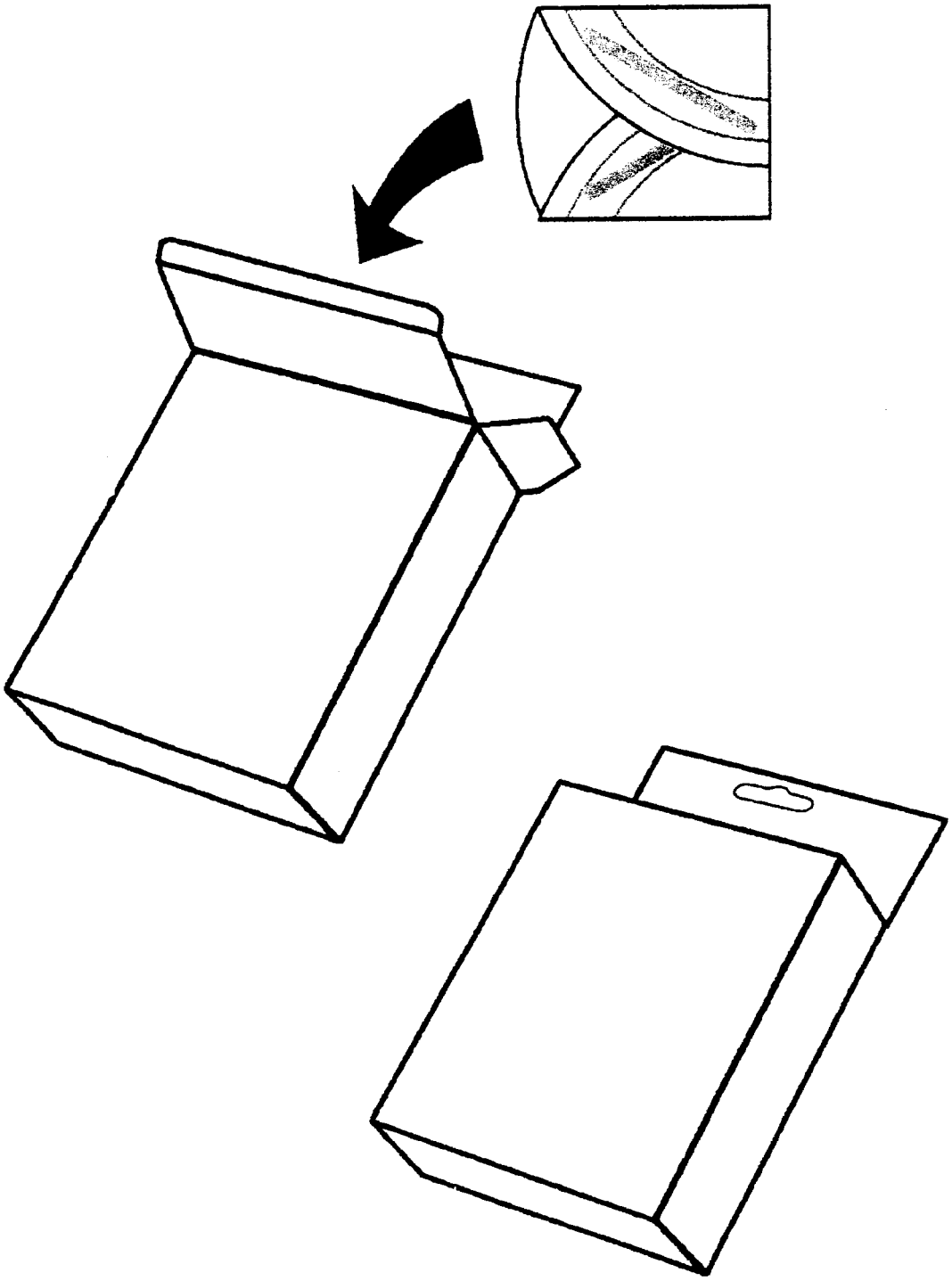
FIG. 14 is a view of the revolving and flying toy according to the fifth embodiment folded at line 14—14 and put into a box.

In the embodiment shown in FIGS. 12–14, six chemical luminous bodies are mounted on a revolving disk-shaped body. The disk-shaped body is folded with the chemical luminous body mounted and packed in a box. When the revolving and flying toy is used, the disk-shaped body is unfolded with the luminous body. The luminous reaction is initiated by bending luminous bodies without taking out from the disk shaped body. The luminous reaction can be initiated either before or after the disk-shaped body is inflated. In this embodiment, since the chemical luminous body is already mounted on the disk-shaped body, the player can easily use the toy.

According to the present invention, there is provided the highly entertaining revolving and flying toy 1, which can be seen in the dark so as not to be lost and which can be manufactured at low cost. The revolving disk-shaped body 2 is made of a soft material and is provided with a ring-shaped air bag on its lower part so that the revolving disk-shaped body 2 can be folded when not in use making it possible to be stored in a much smaller volume. This enables the revolving disk-shaped body 2 to float on the water. With the chemical luminous body 3 which is freely removable, and the revolving disk-shaped body 2 which is provided with the insert pocket 2*g*, said chemical luminous body 3 being freely exchangeable and removable so as to easily change the state of use, the revolving and flying toy 1 can obtain a highly entertaining feature. With the chemical luminous body 3 being arc-shaped, the revolving and flying toy can obtain an even more highly entertaining feature. With the revolving disk-shaped body 2, at least a portion of which is transparent or translucent provided with the chemical luminous body, it is possible to create the revolving and flying toy 1 which is easily recognizable and is hardly lost. With a structure wherein emission of light occurs with a plurality of colors, it is possible to enhance the conspicuousness of the revolving and flying toy 1 thereby heightening its entertaining feature. With the revolving disk-shaped body 2, which is provided with letters, drawings or patterns on its surface, it is possible to enhance the recognizable feature of the revolving and flying toy 1.

What is claimed is:

1. A revolving and flying toy, which is played with by being thrown into the air, comprising:

two types of chemical liquids for chemical luminescence, the two types of chemical liquids capable of emitting light by a chemical reaction when mixed;

a container to separately store the two types of chemical liquids separated by a separating member; and a flying body including a ring-shaped portion capable of holding the container, wherein when the separating member is broken by an outer force, the two types of chemical liquids mixes to emits light by the chemical reaction such that the flying body is recognized in darkness by the light.

2. The revolving and flying toy as set forth in claim 1, wherein the flying body comprises a ring-shaped air bag made of a soft material and capable of folding, the air bag having an air opening through which the air is blown into or released from the air bag so as to inflate or deflate, the flying body keeping a disk shape when the air bag is inflated.

3. The revolving and flying toy as set forth in claims 1 or 2, wherein the container is capable of being mounted onto, and removed from, the flying body.

4. The revolving and flying toy as set forth in claim 3, wherein the flying body comprises an insert pocket in which the container is inserted and the container is removably mounted on the flying body.

5. The revolving and flying toy as set forth in claims 1 or 2, wherein the container is arc-shaped.

6. The revolving and flying toy as set forth in claims 1 or 2, wherein at least a portion of a flying body is made to be transparent or translucent.

7. The revolving and flying toy as set forth in claims 1 or 2, wherein emission of light occurs with a plurality of colors.

8. The revolving and flying toy as set forth in claims 1 or 2, wherein the flying body comprises letters, drawings or patterns on the surface thereof.

9. The revolving and flying toy as set forth in claims 1 or 2, wherein the flying body holds the container such that the flying toy is capable of being folded.

* * * * *